US005670734A

United States Patent [19]

Middione et al.

[11] Patent Number: 5,670,734

[45] Date of Patent: Sep. 23, 1997

[54] MODULAR ARMOR MOUNTING SYSTEM

[75] Inventors: Mark Albert Middione, Scotts Valley; Ron Eugene Musante, Los Altos; James Robert Turner, Campbell, all of Calif.

[73] Assignee: United Defense, L.P., Arlington, Va.

[21] Appl. No.: 321,001

[22] Filed: Oct. 5, 1994

[51] Int. Cl.[6] ..... F41H 5/00

[52] U.S. Cl. ..... 89/36.08; 52/464; 52/506.05; 89/36.04; 296/188; 403/386

[58] Field of Search ..... 29/525.02, 525.03, 29/525.04; 403/384, 386; 269/274, 286; 296/188, 191; 109/64, 79, 81; 114/9, 10, 11; 89/36.01, 36.02, 36.04, 36.03, 36.07, 36.08, 40.03; 52/460, 464, 461, 506.01, 506.05, 509, 716.4, 796.12, 797.1, 468

[56] References Cited

U.S. PATENT DOCUMENTS

| | | | |
|---|---|---|---|
| H129 | 9/1986 | Hansen | 89/36.08 X |
| 1,891,932 | 12/1932 | Hunter | 29/450 |
| 2,356,318 | 8/1944 | Hayman | 269/274 X |
| 3,263,385 | 8/1966 | Pauls | 52/461 |
| 3,430,903 | 3/1969 | Mathes | 29/450 X |
| 5,398,592 | 3/1995 | Turner | 89/36.02 X |
| 5,421,238 | 6/1995 | Catalano | 89/36.08 X |

FOREIGN PATENT DOCUMENTS

| | | | |
|---|---|---|---|
| 1543325 | 4/1979 | United Kingdom | 403/386 |

*Primary Examiner*—Joseph M. Gorski

*Attorney, Agent, or Firm*—Michael B. K. Lee; Douglas W. Rudy

[57] ABSTRACT

The invention provides elastomeric clamps for providing a compliant mounting surface which protects the edges of brittle materials, which can be constituent components in armor panels. Thus the invention prevents concentrated loads around the armor. The invention is modular and allows for modular placement of a plurality of spaced apart armor panel layers.

3 Claims, 5 Drawing Sheets

MODULAR ARMOR MOUNTING SYSTEM

In providing armor to vehicles in military applications, it is desirable to have modular armor that can be adapted to a vehicle according to the situation. Such a modular armor would have a maximum configuration that would protect the vehicle from all possible threats. In another configuration, the modular armor would be lessened to provide a vehicle with a faster speed or which could go a longer distance. Previous mounting schemes relied on screws which penetrated the armor and concentrated loads around the screws. Brittle armor materials are frequently damaged by such concentrated loads around the screws.

The invention provides an apparatus and method for mounting and demounting armor panels as required by battlefield conditions of threat and mobility. The inventive method and apparatus provides a more heavily armored vehicle when needed and a lighter vehicle when needed. In addition, the invention provides a compliant mounting surface which protects the edges of brittle materials, which can be constituent components in armor panels. Thus the invention prevents concentrated loads around the armor.

Figure 1:
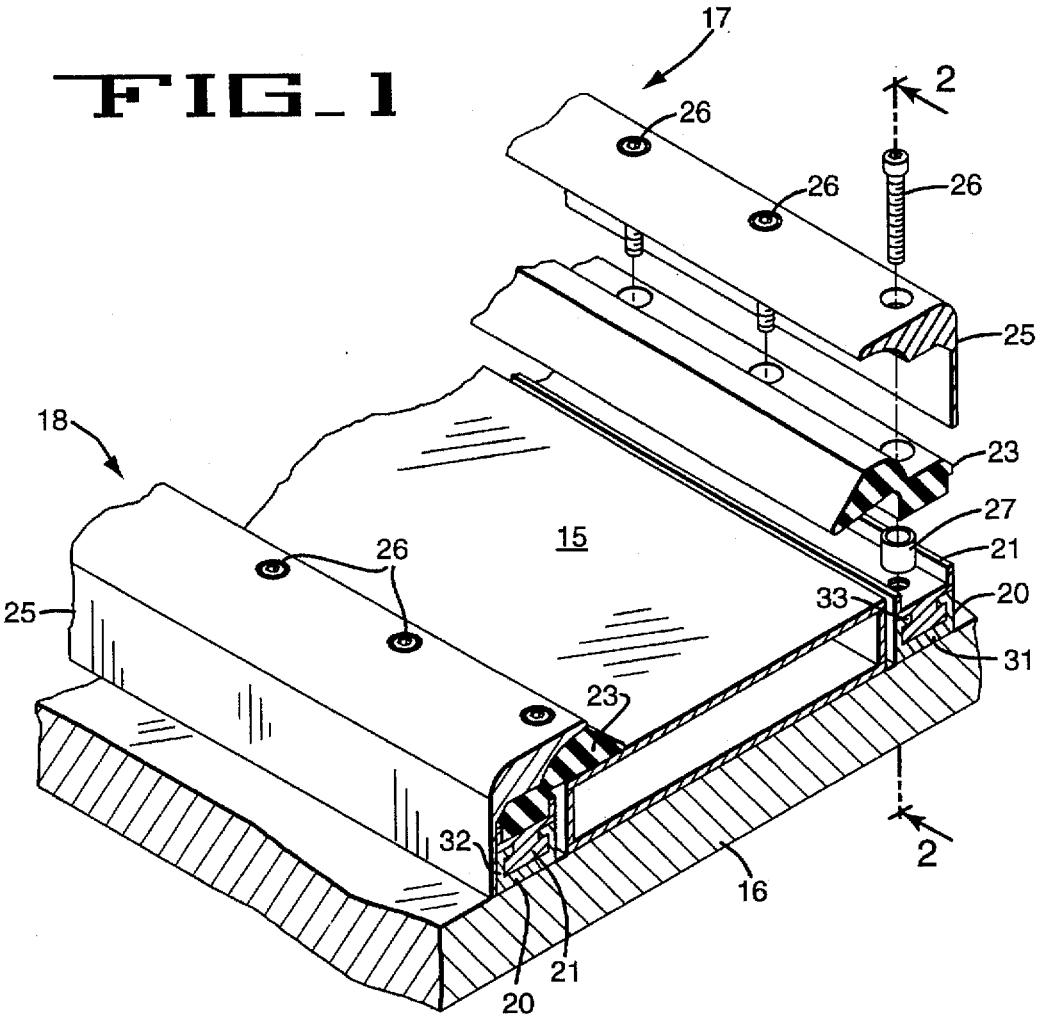
FIG. 1 is a perspective view of an armor panel being held by the inventive mounting system.
Figure 2:
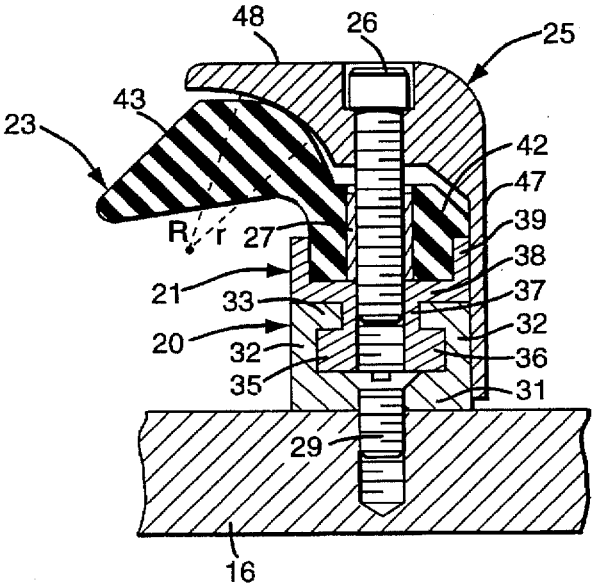
FIG. 2 is a cross sectional view of part of the inventive mounting system taken along cut lines 2—2 of FIG. 1.

In a preferred embodiment, as shown in FIGS. 1 and 2, an armor panel 15 is mounted on a vehicle hull 16 by the inventive mounting system, which comprises a first bracket system 17 and a second bracket system 18. Each of the first and second bracket systems 17, 18 comprise a rail 20, a support bar 21, an elastomeric clamp 23, a cap strip 25, a plurality of cap screws 26, a plurality of bushings 27, and a plurality of rail screws 29. The armor panel 15 is placed against the vehicle hull 16 so that a side with one of the largest surface areas of the armor panel 15 is adjacent to the vehicle hull 16.

The rails 20 are placed on opposite sides of the armor panel 15 against the vehicle hull 16 so that the rails 20 are adjacent to edges of the armor panel 15. The rails 20 are secured to the vehicle hull 16 by a plurality of rail screws 29. The rails 20 are in a U-shape with a cross piece 31 which is adjacent to the vehicle hull 16, upward extending legs 32 which extend from the cross piece 31 away from the vehicle hull 16, and inward extending flanges 33 extending inward from the upward extending legs 32 on the side away from the cross piece 31.

The support bars 21 have a inverted T-shape base and a U-shape top. The cross bar 36 of the inverted T-shape base slides between the upward extending legs 32. The trunk 37 of the inverted T-shape base slides between the inward extending flanges 33 and is connected to the cross-piece 38 of the U-shape top. Upward extending legs 39 of the U-shape top extend from the cross-piece 38 of the U-shape top.

The elastomeric clamp 23 comprises a base 42 and a wing 43. The base 42 is shaped to fit into the U-shape top of the support bars 21. The wing 43 extends to a side and forms a wedge shape. The top of the wing 43 is curved as shown. The cap strip 25 is L-shape and has a side leg 47 and a top leg 48. The side leg 47 is used to guide the cap strip 25 against the rail 20 and support bar 21. The top leg 48 is used to compress the wing 43. The part of the top leg 48 adjacent to the wing 43 is curved. The radius of curvature R of the curved part of the top leg 48 adjacent to the wing 43 is greater than the radius of curvature r of the curved top part of the wing 43.

The bushing 27 is placed in a hole in the elastomeric clamp 23. A cap screw 26 is placed into a hole in the cap strip 25, through the bushing 27 and screwed into a taped hole in the support bar 21. The cap screw 26 forces the cap strip 25 against the elastomeric clamp 23. The curved part of the top leg 48 pushes on the curved part of the wing 43. Since the radius of curvature R of the curved part of the top leg 48 is greater than the radius of curvature r of the curved part of the wing 43, the curved part of the top leg 48 pushes the wing 43 outward and downward, which provides a subtle rolling motion providing a better mounting.

The load bearing force on the armor panel 15 is spread along the contact surface of the elastomeric clamp 23 and the armor panel 15.

Figure 3:
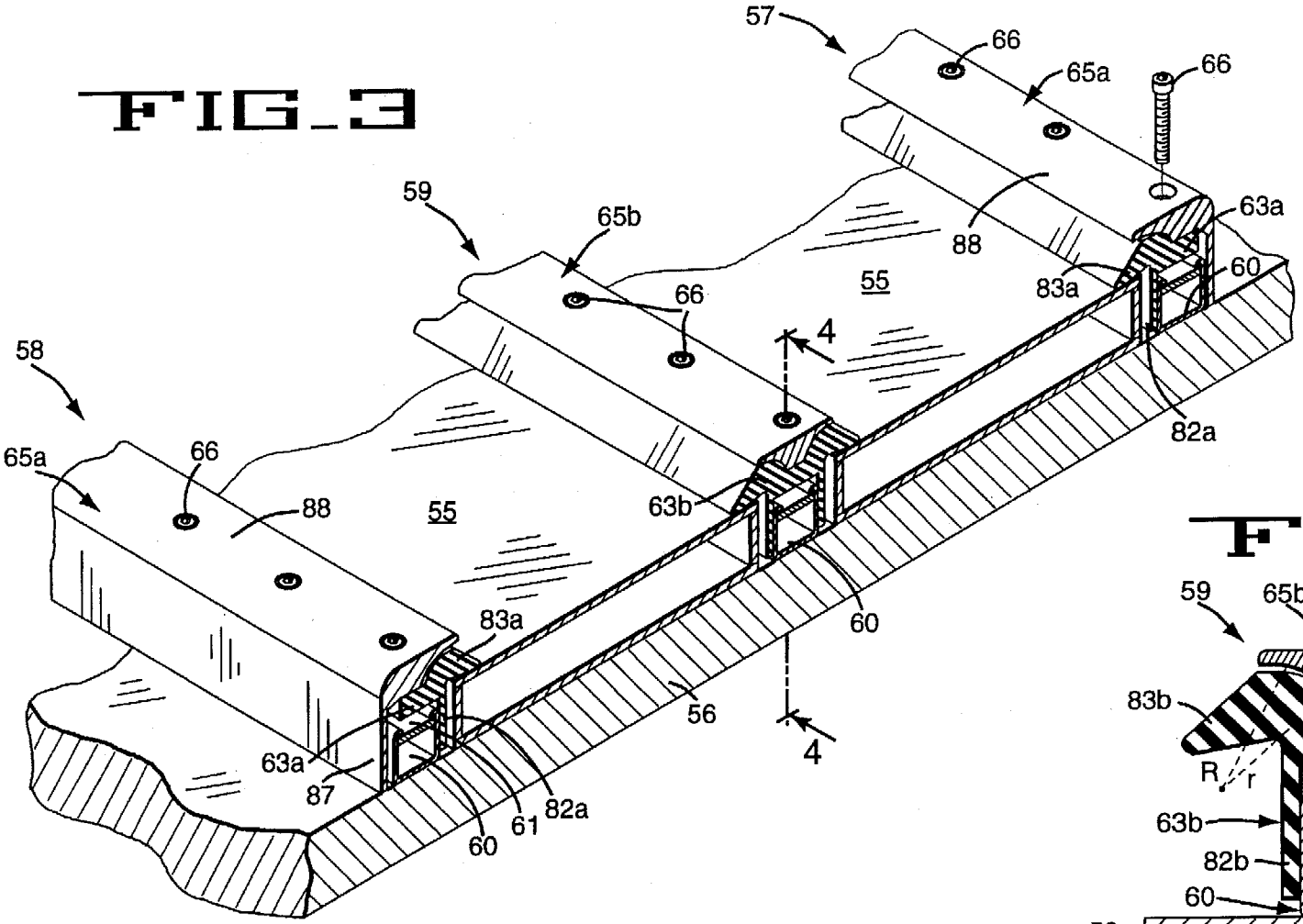
FIG. 3 is a cut away perspective view of two armor panels being held by another preferred embodiment of the inventive mounting system.

The preferred embodiment shown in FIG. 3 comprises a third bracket system 59 added to a first bracket system 57 and a second bracket system 58. The first bracket system 57 and the second bracket system 58 are similar to the first bracket system 17 and the second bracket system of the previous embodiment, in that they are end brackets. The first, second and third bracket systems 57, 58, 59 comprise a rail 60, a support bar 61 and elastomeric clamp 63 a cap strip 65, a plurality of cap screws 66, a plurality of bushings 67 and a plurality of rail screws 69.

Armor panels 55 are placed against the vehicle hull 56 so that a side with one of the largest surface areas of the armor panels 55 are adjacent to the vehicle hull 56. The rails 60 of the first, second and third bracket systems 57, 58, 59 are placed on opposite sides of the armor panels 55 against the vehicle hull 56 so that the rails 60 are adjacent to edges of the armor panels 55. The rails 60 are secured to the vehicle hull 56 by a plurality of rail screws 69. The rails 60 are in a U-shape with a cross piece 71 which is adjacent to the vehicle hull 56, upward extending legs 72 which extend from the cross piece 71 away from the vehicle hull 56, and inwardly curved flanges 73 extending inward from the upward extending legs 72 on the side away from the cross piece 71 and wherein the curve makes a bend of approximately 180° between 160° to 200°.

Figure 4:
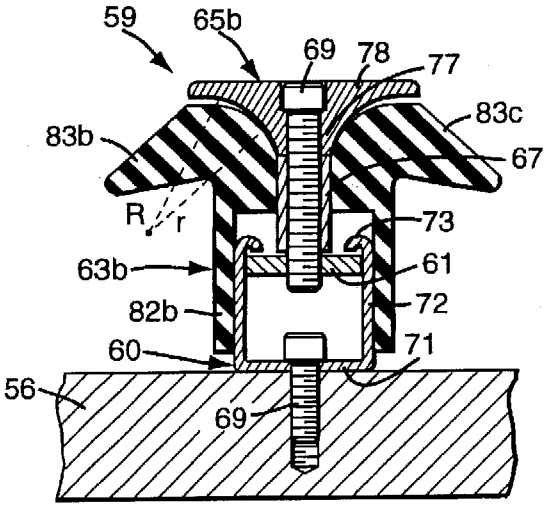
FIG. 4 is a cross sectional view of a bracket system shown in FIG. 3 along lines 4—4.

The support bars 61 of the first, second and third bracket systems 57, 58, 59 in this embodiment comprise a flat sheet with a width equal to the inside distance between the upward extending legs 72, since the support bars pass between the upward extending legs 72 as shown in FIGS. 3 and 4.

The elastomeric clamps 63*a* for the first and second bracket systems 57, 58 comprise a base 82*a* and a wing 83*a*. The base 82*a* is shaped to fit around the outside of the rails 60. The wing 83*a* extends to a side and forms a wedge shape. The top of the wing 83*a* is curved as shown. The elastomeric clamp 63*b* for the third bracket system 59 comprise a base 82*b* and a first and a second wings 83*b*, 83*c*. The base 82*b* is shaped to fit around the outside of the rails 60. First wing 83*b* extends to a first side of the elastomeric clamp 63*b* and forms a wedge shape. The top of the first wing 83*b* is curved as shown. Second wing 83*c* extends to a second side of the elastomeric clamp 63b and forms a wedge shape. The top of the second wing 83c is curved as shown. The cap strips 65a for the first and second bracket systems 57, 58 are L-shape and have a side leg 87 and a top leg 88. The side leg 87 is used to guide the cap strip 65a against the rail 60. The top leg 88 is used to compress the wing 83a. The part of the top leg 88 adjacent to the wing 83a is curved. The radius of curvature R of the curved part of the top leg 88 adjacent to the wing 83a is greater than the radius of curvature r of the curved top part of the wing 83a. The cap strip 65b for the third bracket system 59 is T-shape and has a base 77 and a top 78. The base fits between the curved part of the first wing 83b and the curved part of the second wing 83c. The top 78 is used to compress the first and second wings 83b, c. The part of the top 78 adjacent to the wings 83b, c is curved. The radius of curvature R of the curved part of the top 78 adjacent to the wings 83b, c is greater than the radius of curvature r of the curved top part of the wings 83b, c.

The bushings 67 are placed in holes in the elastomeric clamps 63a, b. Cap screws 66 are placed into a holes in the cap strips 65a, b, through the bushings 67 and screwed into a taped hole in the support bars 61. The cap screw 66 forces the cap strips 65a, b against the elastomeric clamps 63a, b. The curved part of the top legs 88 push on the curved part of the wings 83a of the first and second bracket systems 57, 58. The curved part of the top 78 pushes on the curved part of the wings 83b, c of the third bracket system 59. Since the radius of curvature R of the curved part of the top legs 88 are greater than the radius of curvature r of the curved part of the wing 83a of the first and second bracket systems 57, 58, the curved part of the top legs 88 push the wings 83a outward and downward, which provides a subtle rolling motion providing a better mounting. Since the radius of curvature R of the curved parts of the top 78 is greater than the radius of curvature r of the curved parts of the wings 83b of the third bracket system 59, the curved parts of the top 78 push the wings 83b, c outward and downward, which provides a subtle rolling motion providing a better mounting.

Figure 5:
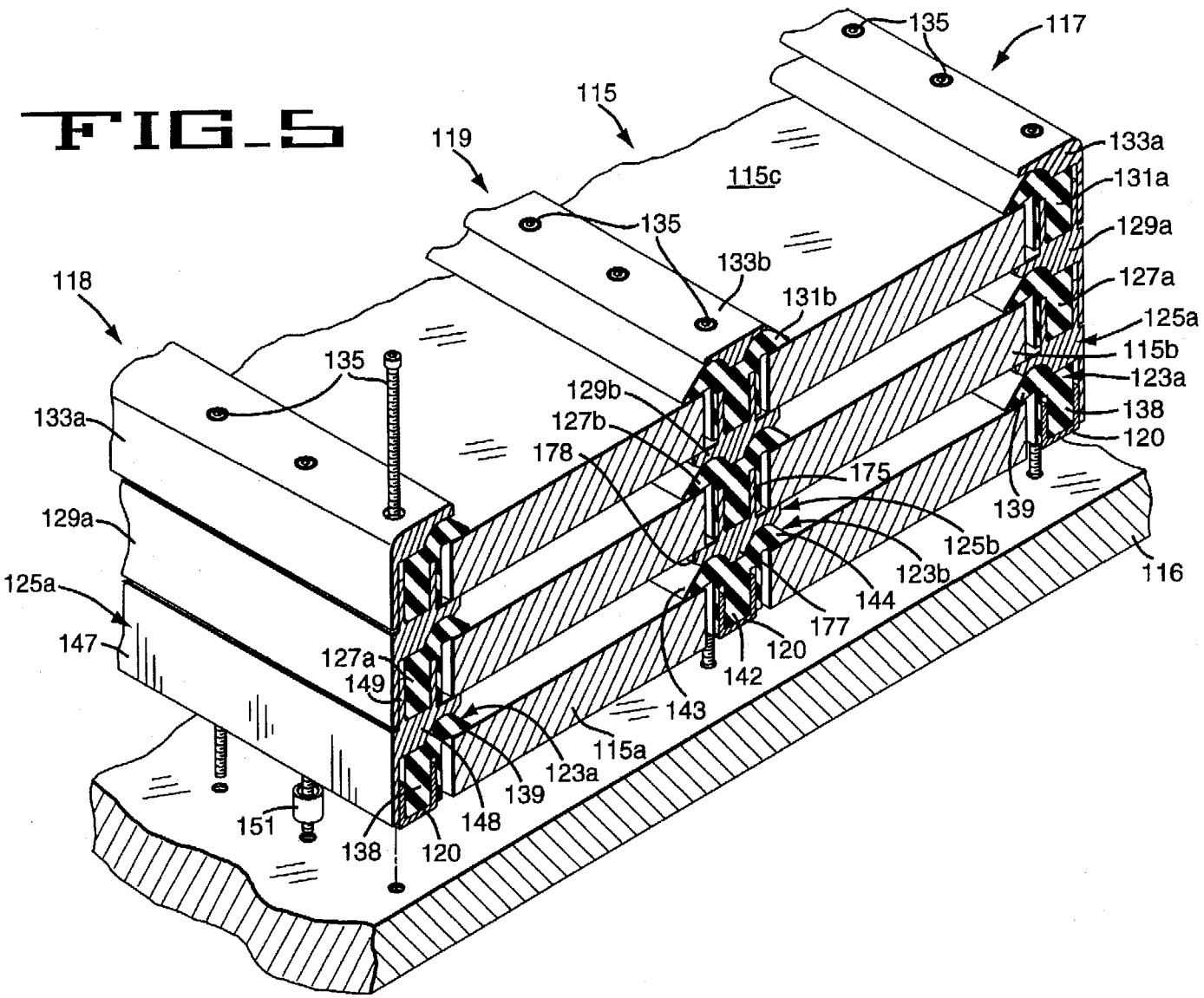
FIG. 5 is a perspective view of another embodiment of the invention, which holds multiple layers of armor panels.

FIG. 5 is a perspective view of a first bracket system 117, a second bracket system 118 and a third bracket system 119, which help to hold three layers of armor panels 115 parallel to a vehicle hull 116. The first, second and third bracket systems 117, 118, and 119 comprise rails 120, a first elastomeric clamp 123, a first cap strip 125, a second elastomeric clamp 127, a second cap strip 129, a third elastomeric clamp 131, a third cap strip 133, and a plurality of bolts 135.

The rails 120 of the first, second, and third bracket systems 117, 118, 119 are U-shape with a cross piece and two upward extending legs as shown. The first elastomeric clamps 123a of the first and second bracket systems 117, 118 comprise a base 138 and a wing 139. The base 138 of the first elastomeric clamps 123a of the first and second bracket systems 117, 118 has a groove into which an upward extending leg of the U-shape rail 120 fits, so that the base 138 is both inside the U-shape rail 120 and outside on one side of the U-shape rail 120. The wing 139 extends to a side of the base and forms a wedge shape. The top of the wing 139 is curved as shown.

The first elastomeric clamp 123b of the third bracket system 119 has a base 142, a first wing 143 extending to a first side of the base, and a second wing 144 extending to a second side of the base 142. The base 142 of the first elastomeric clamp 123b of the third bracket system 119 has two grooves into which both of the upward extending legs of the U-shape rail 120 fit, so that the base 142 fills the inside of the rail 120 and extends around both sides outside of the rail 120. The first wing 143 extends to a first side of the first elastomeric clamp 123b and forms a wedge shape. The top of the first wing 143 is curved as shown. The second wing 144 extends to a second side of the first elastomeric clamp 123b and forms a wedge shape. The top of the second wing 144 is curved as shown.

The first cap strips 125a for the first and second bracket systems 117, 118 have an L-shape part having a side leg 147 and a top leg 148. The side leg 147 is used to guide the first cap strip 125a against the rail 120. The top leg 148 is used to compress the wing 139 of the first elastomeric clamp 123a. A U-shape part is joined on top of the top leg 148, with the top leg 148 forming the cross piece of the U-shape and with upward extending legs 149 extending from the top leg 148. The part of the top leg 148 adjacent to the wing 139 is curved. The radius of curvature R of the curved part of the top leg 148 adjacent to the wing 139 is greater than the radius of curvature r of the curved top part of the wing 139. The first cap strip 125b for the third bracket system 119 has a T-shape part which has a base 177 and a top 178. The base fits between the curved part of the first wing 143 and the curved part of the second wing 144. The top 178 is used to compress the first and second wings 143, 144. The part of the top 178 adjacent to the wings 143, 144 is curved. The radius of curvature of the curved part of the top 178 adjacent to the wings 143, 144 is greater than the radius of curvature of the curved top part of the wings 143, 144. A U-shape part is joined to the top 178 of the first cap strip 125b of the third bracket system 119, with the top 178 forming a cross piece and with upward extending legs 175 extending upward from the top 178.

The second elastomeric clamps 127a of the first and second bracket systems 117, 118 have the same shape as the first elastomeric clamps 123a of the first and second bracket systems 117, 118. The base of the second elastomeric clamps 127a of the first and second bracket systems 117, 118 fit around the upward extending legs 149 of the first cap strips 125a of the first and second bracket systems 117, 118. The second elastomeric clamps 127b of the third bracket system 119 has the same shape as the first elastomeric clamp 123b of the third bracket system 119. The base of the second elastomeric clamp 127b of the third bracket system 119 fits around the upward extending legs 175 of the first cap strips 125b of the third bracket system 119.

The second cap strips 129a of the first and second bracket systems 117, 118 have the same shape as the first cap strips 125a of the first and second bracket systems 117, 118. The second cap strips 129a of the first and second bracket systems 117, 118 fit around the second elastomeric clamps 127a in the same manner that the first cap strips 125a fit around the first elastomeric clamps 123a of the first and second bracket systems 117, 118. The second cap strip 129b of the third bracket system 119 has the same shape as the first cap strip 125b of the third bracket system 119. The second cap strip 129b of the third bracket system 119 fits on the second elastomeric clamps 127b in the same manner that the first cap strip 125b fits on the first elastomeric clamp 123b of the third bracket system 119.

The third elastomeric clamps 131a of the first and second bracket systems 117, 118 have the same shape as the first elastomeric clamps 123a of the first and second bracket systems 117, 118. The base of the third elastomeric clamps 131a of the first and second bracket systems 117, 118 fit around the upward extending legs of the second cap strips 129a of the first and second bracket systems 117, 118. The third elastomeric clamps 131b of the third bracket system 119 has the same shape as the first elastomeric clamp 123b of the third bracket system 119. The base of the third elastomeric clamp 131*b* of the third bracket system 119 fits around the upward extending legs of the second cap strips 129*b* of the third bracket system 119.

The third cap strips 133*a* of the first and second bracket systems 117, 118 have the same shape as the first cap strips 125*a* of the first and second bracket systems 117, 118, except that the third cap strips 133*a* do not have upward extending legs. The third cap strips 133*a* of the first and second bracket systems 117, 118 fit around the third elastomeric clamps 131*a* in the same manner that the first cap strips 125*a* fit around the first elastomeric clamps 123*a* of the first and second bracket systems 117, 118. The third cap strip 133*b* of the third bracket system 119 has the same shape as the first cap strip 125*b* of the third bracket system 119, except that the third cap strips 133*b* do not have upward extending legs. The third cap strip 133*b* of the third bracket system 119 fits on the third elastomeric clamps 131*b* in the same manner that the first cap strip 125*b* fits on the first elastomeric clamp 123*b* of the third bracket system 119.

A first layer of armor panels 115*a* is supported between the first elastomeric clamps 123. A second layer of armor panels 115*b* is supported between the second elastomeric clamps 127 and on top of the first cap strips 125. A third layer of armor panels 115*c* is supported between the third elastomeric clamps 133 and on top of the second cap strips 129. A plurality of bolts 135 secure the first, second and third bracket systems 117, 118, 119. A bolt passes through a hole in the third cap strip 133, the third elastomeric clamp 131, the second cap strip 129, the second elastomeric clamp 127, the first cap strip 125, and the first elastomeric clamp 123, into a tapped hole in the vehicle hull 15. Bushings 151 are placed in the elastomeric clamps 123, 127, 131 to give strength to the bolts 135. Once again the differences in the radius of curvatures creates a rolling motion providing better securing of the panels.

Figure 6:
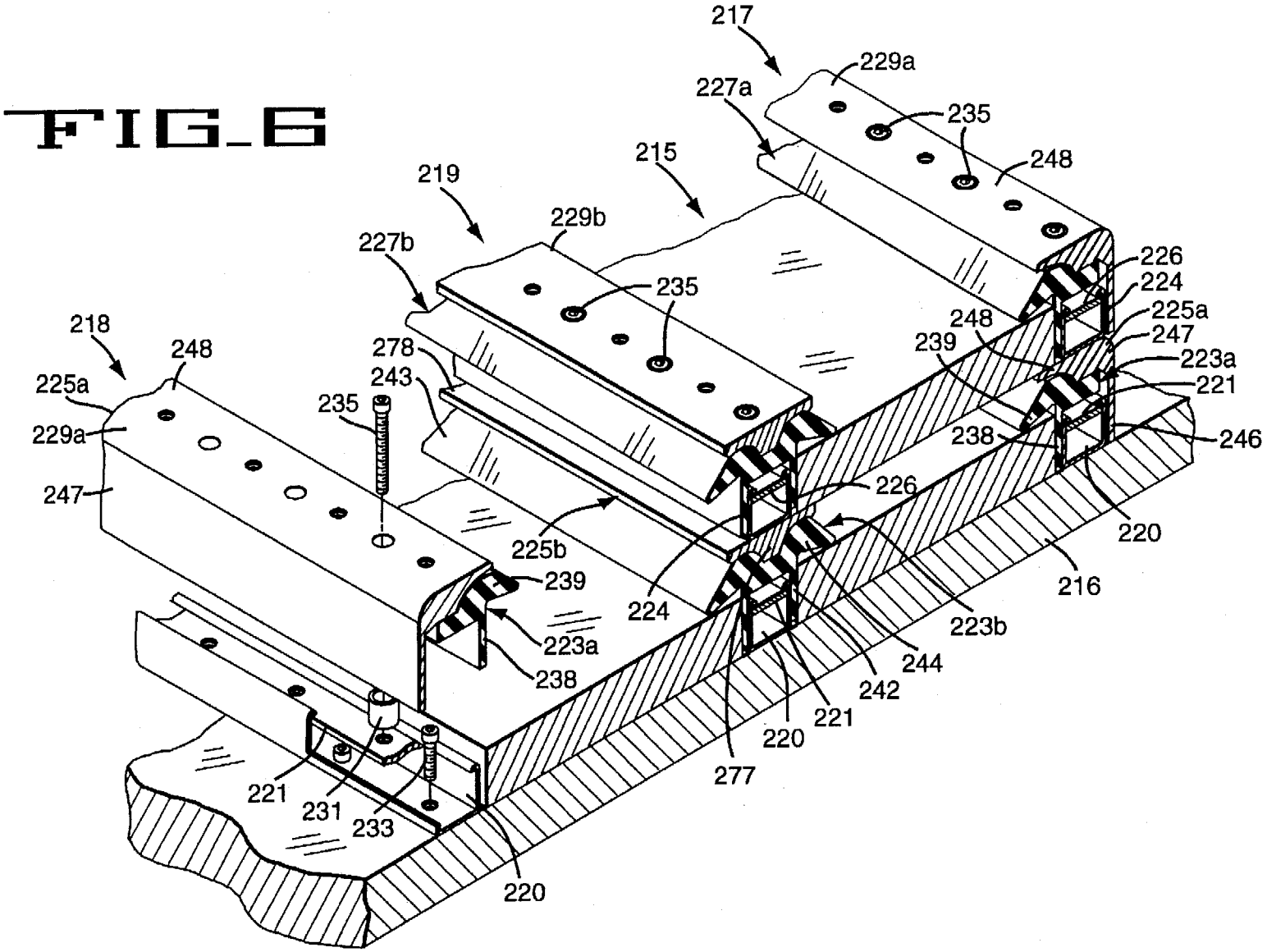
FIG. 6 is a perspective view of another embodiment of the invention showing another system for holding multiple layers of armor panels.

FIG. 6 is a perspective view of a first bracket system 217, a second bracket system 218 and a third bracket system 219, which help to hold two layers of armor panels 215 parallel to a vehicle hull 216. The first, second and third bracket systems 217, 218, and 219 comprise a first rail 220, a first support bar 221, a first elastomeric clamp 223, a first cap strip 225, a second rail 224, a second support bar 226, a second elastomeric clamp 227, a second cap strip 229, a plurality of bushings 231, a plurality of rail bolts 233 and a plurality of cap bolts 235.

The first rails 220 of the first, second, and third bracket systems 217, 218, 219 are identical to the rails 60 shown in FIGS. 3 and 4, and therefore are U-shape with a cross piece which is adjacent to the vehicle hull 216, upward extending legs which extend from the cross piece away from the vehicle hull 216, and inwardly curved flanges extending inward from the upward extending legs on the side away from the cross piece and wherein the curve makes a bend of approximately 180° between 160° to 200°. The first rails 220 are bolted to the vehicle hull 216 by a plurality of rail bolts 233 bolted into tapped holes in the vehicle hull 216. The first support bars 221 of the first, second and third bracket systems 57, 58, 59 in this embodiment are identical to the support bars 61 shown in FIGS. 3 and 4 and therefore comprise a flat sheet with a width equal to the inside distance between the upward extending legs of the first rails 60, since the support bars pass between the upward extending legs as shown in FIG. 6.

The first elastomeric clamps 223*a* of the first and second bracket systems 217, 218 comprise a base 238 and a wing 239. The base 238 of the first elastomeric clamps 223*a* of the first and second bracket systems 217, 218 surrounds the upward extending leg of the first rail 220. The wing 239 extends to a side of the base and forms a wedge shape. The top of the wing 239 is curved as shown. The first elastomeric clamp 223*b* of the third bracket system 219 has a base 242, a first wing 243 extending to a first side of the base, and a second wing 244 extending to a second side of the base 242. The base 242 of the third bracket system 219 surrounds the first rail 220 The first wing 243 extends to a first side of the first elastomeric clamp 223*b* and forms a wedge shape. The top of the first wing 243 is curved as shown. The second wing 244 extends to a second side of the first elastomeric clamp 223*b* and forms a wedge shape. The top of the second wing 244 is curved as shown.

The first cap strips 225*a* for the first and second bracket systems 217, 218 have an L-shape part having a side leg 247 and a top leg 248. The side leg 247 is used to guide the first cap strip 225*a* against the first rail 220. The top leg 248 is used to compress the wing 239 of the first elastomeric clamp 223*a*. The part of the top leg 248 adjacent to the wing 239 is curved. The radius of curvature R of the curved part of the top leg 248 adjacent to the wing 239 is greater than the radius of curvature r of the curved top part of the wing 239. The first cap strips 225*a* are identical to the cap strips 65 shown in FIGS. 3 and 4, except that the first cap strips have additional tapped holes between the holes in the cap strips 65 shown in FIGS. 3 and 4. The first cap strip 225*b* for the third bracket system 219 has a T-shape part which has a base 277 and a top 278. The base fits between the curved part of the first wing 243 and the curved part of the second wing 244. The top 278 is used to compress the first and second wings 243, 244. The part of the top 278 adjacent to the wings 243, 244 is curved. The radius of curvature of the curved part of the top 278 adjacent to the wings 243, 244 is greater than the radius of curvature of the curved top part of the wings 243, 244.

The bushings 231 are placed in holes in the first elastomeric clamps 223. Cap bolts 235 are placed into untapped holes in the first cap strips 225, through the bushings 231 and screwed into a taped hole in the first support bars 221. The cap bolts 235 force the first cap strips 225 against the first elastomeric clamps 223. The curved part of the top legs 247 push on the curved part of the wings 239 of the first and second bracket systems 217, 218. The curved part of the top 278 pushes on the curved part of the first and second wings 243, 244 of the third bracket system 219. Since the radius of curvature R of the curved part of the top legs 248 are greater than the radius of curvature r of the curved part of the wing 239 of the first and second bracket systems 217, 218, the curved part of the top legs 248 push the wings 239 outward and downward, which provides a subtle rolling motion providing a better mounting. Since the radius of curvature of the curved parts of the top 278 is greater than the radius of curvature of the curved parts of the first and second wings 243, 244 of the third bracket system 219, the curved parts of the top 278 push the first and second wings 243, 244 outward and downward, which provides a subtle rolling motion providing a better mounting.

The second rails 224 are identical to the first rails 220. Rail bolts 233 are used to bolt the second rails 224 to the tapped holes in the first cap strips 225. The second support bars 226 are identical to the first support bars 221. The second support bars 226 are placed between the upward extended legs of the second rails 224.

The second elastomeric clamps 227*a* of the first and second bracket systems 217, 218 have the same shape as the first elastomeric clamps 223*a* of the first and second bracket systems 217, 218. The base of the second elastomeric clamps 227*a* of the first and second bracket systems 217, 218 fit around the upward extending legs of the second rails 224 of the first and second bracket systems 217, 218. The second elastomeric clamps 227*b* of the third bracket system 219 has the same shape as the first elastomeric clamp 223*b* of the third bracket system 219. The base of the second elastomeric clamp 227*b* of the third bracket system 219 fits around the upward extending legs second rail 224 of the third bracket system 219.

The second cap strips 229*a* of the first and second bracket systems 217, 218 have the same shape as the first cap strips 225*a* of the first and second bracket systems 217, 218. The second cap strips 229*a* of the first and second bracket systems 217, 218 fit around the second elastomeric clamps 227*a* in the same manner that the first cap strips 225*a* fit around the first elastomeric clamps 223*a* of the first and second bracket systems 217, 218. The second cap strip 229*b* of the third bracket system 219 has the same shape as the first cap strip 225*b* of the third bracket system 219. The second cap strip 229*b* of the third bracket system 219 fits on the second elastomeric clamps 227*b* in the same manner that the first cap strip 225*b* fits on the first elastomeric clamp 223*b* of the third bracket system 219.

The bushings 231 are placed in holes in the second elastomeric clamps 227. Cap bolts 235 are placed into untapped holes in the second cap strips 229, through the bushings 231 and screwed into a taped hole in the second support bars 226. The cap bolts 235 force the second cap strips 229 against the second elastomeric clamps 227. The curved part of the top legs push on the curved part of the wings of the first and second bracket systems 217, 218. The curved part of the top pushes on the curved part of the first and second wings of the third bracket system 219. Since the radius of curvature of the curved part of the top legs are greater than the radius of curvature of the curved part of the wing of the first and second bracket systems 217, 218, the curved part of the top legs push the wings outward and downward, which provides a subtle rolling motion providing a better mounting. Since the radius of curvature of the curved parts of the top is greater than the radius of curvature of the curved parts of the first and second wings of the third bracket system 219, the curved parts of the top push the first and second wings outward and downward, which provides a subtle rolling motion providing a better mounting.

As shown in FIG. 6, the armor panels 215 are mounted between the elastomeric clamps. Thus providing multiple layers or armor with rubber mounts and where one layer can be easily added or removed.

Figure 7:
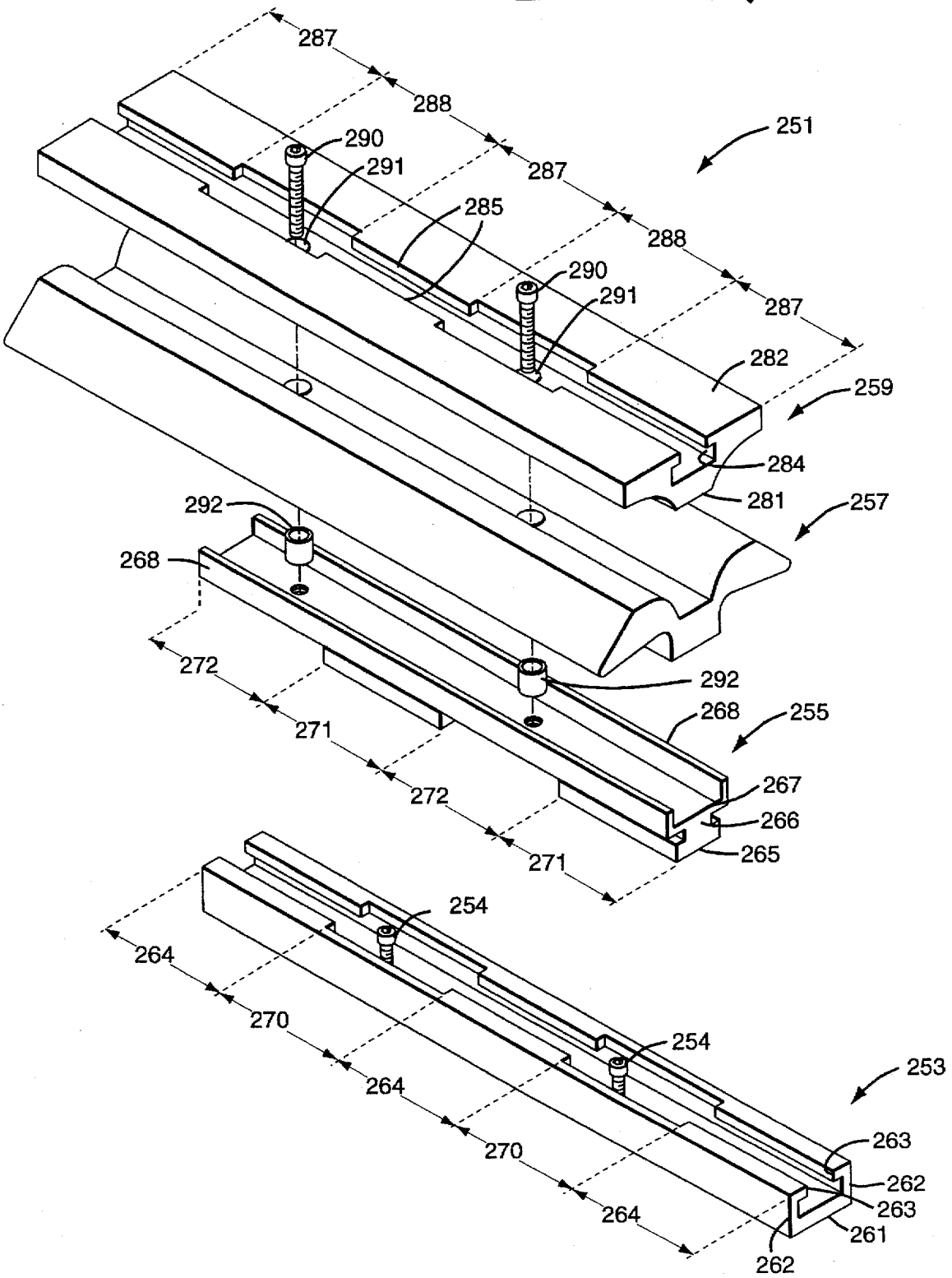
FIG. 7 is an exploded view of another embodiment of a bracket system.

FIG. 7 is an exploded view of another embodiment of a bracket system. The exploded bracket system shown in FIG. 7 is a third bracket system 251, but may also be used on a first or second bracket system. The third bracket system 251 comprises a rail 253, a support bar 255, an elastomeric clamp 257 and a cap strip 259. The rail 253 is placed on the side of a armor panel against a hull. The rail 253 is secured to the hull by a plurality of rail screws 254. The rail 253 is in a U-shape with a cross piece 261 which is adjacent to the hull, upward extending legs 262 which extend from the cross piece 261 away from the hull and inward extending flanges 263 extending inward from the upward extending legs 262 on the side away from the cross piece 261. The inward extending flanges 263 are complete over flange regions 264. Between the flange regions 264 are gaps in a gap region 270 where the flanges 263 are not complete. The gap regions 270 cause the inward extending flanges 263 to be discontinuous making a square wave pattern as shown in FIG. 7.

The support bar 255 has a inverted T-shape base and a U-shape top. The cross bar 265 of the inverted T-shape base is complete at bar regions 271. Between the base regions 271 are gap regions 272 where the cross bar 265 is not complete. To install the support bar 255 into the rail 253 the bar regions 271 are placed over the gap regions 270 of the rail 253 and the gap regions of the support bar 255 are placed over the flange regions 264. The rail 253 and support bar 255 are then placed together, with the cross bar 265 passing through the gap region 270 of the rail 253 to a position between the upward extending legs 262 and with the inward extending flanges 263 passing around the gap region 272 of the support bar 255. The rail 253 and the support bar 255 are slid linearly in opposite directions with respect to each other causing the inward extending flanges 263 to engage with the cross bar 265. The trunk 266 of the inverted T-shape base slides between the inward extending flanges 263 and is connected to the cross-piece 267 of the U-shape top. Upward extending legs 268 of the U-shape top extend from the cross-piece 267 of the U-shape top.

The elastomeric clamp 257 comprises a base and wings. The cap strip 259 is T-shape. The base 281 of the cap strip 259 fits between the wings of the elastomeric clamp 257. The top 282 of the cap strip 259 fits over the wings of the elastomeric clamp 257. A rail is built into the top of the cap strip 259. This rail is formed by a U-shape groove 284 in the cap strip 259 and inward extending flanges 285. The inward extending flanges 285 are complete over flange regions 287. Between the flange regions 287 are gaps in a gap region 288 where the flanges 285 are not complete. The gap regions 288 cause the inward extending flanges 285 to be discontinuous making a square wave pattern as shown in FIG. 7.

Cap bolts 290 pass through holes 291 in the cap strip 259 and then through bushings 292 placed in holes in the elastomeric clamp 257 and then into tapped holes in the support bar 255. The cap strip 259, elastomeric clamp 257 and support bar 255 are bolted together forming a clamping unit. Another clamping unit may be connected to the top of the cap strip 259 in the same manner as this clamping unit is connected to the rail 253 by the support bar 255. This allows for a stack of clamping units to be assembled without needing to bolt the clamping units together when put in place. Instead the clamping units may be bolted together ahead of time and then stored until needed for quick assembly of a bracket system.

While a preferred embodiments of the present invention have been shown and described herein, it will be appreciated that various changes and modifications may be made therein without departing from the spirit of the invention as defined by the scope of the appended claims.

What is claimed is:

1. An apparatus for mounting armor panels on a hull, comprising:

a first elastomeric clamp along a first side of an armor panel, wherein the first elastomeric clamp, comprises:

a base;

a first wing on one side of the base and adjacent to the first side of the armor panel, wherein the wing is a wedge shape; and a second wing on a second side of the base and along a first side of a second armor panel, wherein the second wing is wedge shape;

a first cap strip with a top part, wherein the first elastomeric clamp is between the hull and the first cap strip;

means mechanically connecting the first cap strip to the hull and for providing a force on the first cap strip towards the hull and compressing the first elastomeric clamp;

a second elastomeric clamp along a second side of the armor panel, wherein the second elastomeric clamp, comprises:

a base; and a wing on one side of the base and adjacent to the second side of the armor panel, wherein the wing is wedge shape;

a second cap strip with a top part, wherein the second elastomeric clamp is between the hull and the second cap strip, wherein the top of the first wing of the first elastomeric clamp is curved, and wherein the part of the first cap adjacent to the top of the first wing of the first elastomeric clamp is curved with a radius of curvature greater than the radius of curvature of the top of the first wing of the first elastomeric clamp, and wherein the top of the second wing of the first elastomeric clamp is curved, and wherein the part of the first cap adjacent to the top of the second wing of the first elastomeric clamp is curved with a radius of curvature greater than the radius of curvature of the top of the second wing of the first elastomeric clamp with the first cap forming a T-shape, and wherein the top of the wing of the second elastomeric clamp is curved, and wherein the part of the second cap adjacent to the top of the wing of the second elastomeric clamp is curved with a radius of curvature greater than the radius of curvature of the top of the wing of the second elastomeric clamp;

means mechanically connecting the second cap strip to the hull and for providing a force on the second cap strip towards the hull and compressing the second elastomeric clamp:

a third elastomeric clamp along a second side of the second armor panel, wherein the third elastomeric clamp, comprises:

a base; and a wing on one side of the base and adjacent to the second side of the second armor panel, wherein the wing is wedge shape;

a third cap strip with a top part, wherein the third elastomeric clamp is between the hull and the third cap strip;

means mechanically connecting the third cap strip to the hull and for providing a force on the third cap strip towards the hull and compressing the third elastomeric clamp;

a fourth elastomeric clamp along a first side of an third armor panel and a first side of a fourth armor panel, wherein the first elastomeric clamp, comprises:

a base;

a first wing on a first side of the base and adjacent to the first side of the third armor panel, wherein the first wing is wedge shape; and a second wing on a second side of the base and adjacent to the first side of the fourth armor panel, wherein the second wing is wedge shape;

a fourth cap strip with a top part, wherein the fourth elastomeric clamp is between the first cap strip and the fourth cap strip;

means mechanically connecting the fourth cap strip to the first cap strip and for providing a force on the fourth cap strip towards the first cap strip and compressing the fourth elastomeric clamp;

a fifth elastomeric clamp along a second side of the third armor panel, wherein the fifth elastomeric clamp, comprises:

a base; and a wing on one side of the base and adjacent to the second side of the third armor panel, wherein the wing is wedge shape;

a fifth cap strip with a top part, wherein the fifth elastomeric clamp is between the fifth cap strip and the second cap strip;

means mechanically connecting the fifth cap strip to the second cap strip and for providing a force on the fifth cap strip towards the second cap strip and compressing the fifth elastomeric clamp;

a sixth elastomeric clamp along a second side of the fourth armor panel, wherein the sixth elastomeric clamp, comprises:

a base; and a wing on one side of the base and adjacent to the second side of the fourth armor panel, wherein the wing is wedge shape;

a sixth cap strip with a top part, wherein the sixth elastomeric clamp is between the sixth cap strip and the third cap strip; and means mechanically connecting the sixth cap strip to the third cap strip and for providing a force on the sixth cap strip towards the third cap strip and compressing the sixth elastomeric clamp.

2. The apparatus, as recited in claim 1, further comprising:

a first U-shape rail mechanically connected between the hull and the first elastomeric clamp along the first side of the armor panel and the first side of the second armor panel;

a second U-shape rail mechanically connected between the hull and the second elastomeric clamp along the second side of the armor panel; and a third U-shape rail mechanically connected between the hull and the third elastomeric clamp along a second side of the second armor panel.

3. The apparatus, as recited in claim 2, wherein the first U-shape rail, comprises:

a cross piece;

a first upward extending leg extending from the cross piece with a side furthest from the cross piece;

a second upward extending leg parallel to the first upward extending leg extending from the cross piece with a side furthest from the cross piece;

a first curved flange on the side of the first upward extending leg furthest from the cross piece; and a second curved flange on the side of the second upward extending leg furthest from the cross piece.

* * * * *